US010844660B2

(12) United States Patent
Leng

(10) Patent No.: US 10,844,660 B2
(45) Date of Patent: Nov. 24, 2020

(54) FOLDING LADDER WITH ARMREST

(71) Applicant: NEW-TEC INTEGRATION (XIAMEN) CO., LTD., Fujian (CN)

(72) Inventor: Luhao Leng, Fujian (CN)

(73) Assignee: NEW-TEC INTEGRATION (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 15/786,120

(22) Filed: Oct. 17, 2017

(65) Prior Publication Data

US 2018/0148977 A1 May 31, 2018

(30) Foreign Application Priority Data

Nov. 28, 2016 (CN) ..... 2016 2 1283174 U

(51) Int. Cl.
*E06C 1/387* (2006.01)
*E06C 7/18* (2006.01)
*E06C 1/393* (2006.01)

(52) U.S. Cl.
CPC ..... *E06C 1/387* (2013.01); *E06C 1/393* (2013.01); *E06C 7/182* (2013.01)

(58) Field of Classification Search
CPC . E06C 1/22; E06C 1/393; E06C 1/383; E06C 1/3835; E06C 7/182; A47C 12/00
See application file for complete search history.

(56) References Cited

U.S. PATENT DOCUMENTS 1,179,391 A * 4/1916 Bachman ..... E06C 7/44 182/204
2,230,015 A * 1/1941 Rich ..... E06C 1/387 182/161
2,388,892 A * 11/1945 Wilson ..... E06C 1/20 182/106
4,320,817 A * 3/1982 Knoke ..... A47C 12/02 182/126
4,485,892 A * 12/1984 Maloney ..... E06C 1/393 182/161
5,526,898 A * 6/1996 Clark ..... E06C 7/44 182/108
5,625,923 A * 5/1997 Huang ..... B62B 9/20 16/429
D401,353 S * 11/1998 Bell ..... D25/64
6,012,548 A * 1/2000 Kim ..... E06C 1/387 182/156
6,347,687 B1 * 2/2002 Alim ..... E06C 1/387 182/159

(Continued)

*Primary Examiner* — Katherine W Mitchell
*Assistant Examiner* — Shiref M Mekhaeil
(74) *Attorney, Agent, or Firm* — Cooper Legal Group, LLC

(57) ABSTRACT

A folding ladder with an armrest, has two front legs, two rear legs, two shaft sleeves and at least a footboard, two shaft sleeves are respectively sleeved on the top portion of the two front legs, the top portion of the two rear legs are respectively rotatably pivoted to the two shaft sleeves; further comprising an armrest, the armrest comprises two movable bars and a link bar, two movable bars are respectively connected to the two front legs in stretchable way, the link bar is connected between the two movable bars; the shaft sleeve is disposed with an adjustable switch to control the movable bar to stretch out and draw back. The adjustable switch has a handle, a position pin disposed at one end of the handle and an elastic element disposed at the other end of the handle.

9 Claims, 4 Drawing Sheets

(56) References Cited

U.S. PATENT DOCUMENTS 6,443,261 B1 * 9/2002 Gibson ..... E06C 1/16 182/104
6,536,557 B2 * 3/2003 Gibson ..... E06C 1/393 182/129
6,550,579 B2 * 4/2003 Gibson ..... E06C 1/387 182/161
6,902,035 B2 * 6/2005 Baumgartner ..... E06C 1/393 182/165
8,146,710 B2 * 4/2012 Moldthan ..... E06C 1/393 182/165
8,186,481 B2 * 5/2012 Moss ..... F16B 7/105 182/129
9,016,434 B2 * 4/2015 Moss ..... E06C 7/14 182/106
9,314,100 B1 * 4/2016 Logan ..... A47C 1/14
D797,955 S * 9/2017 Wilbur ..... D25/65
9,869,125 B2 * 1/2018 Simpson ..... E06C 1/393
10,138,680 B2 * 11/2018 Williams ..... E06C 7/14
10,487,576 B2 * 11/2019 Ballard ..... E06C 7/06
2002/0017430 A1 * 2/2002 Rosko ..... E06C 1/387 182/129
2002/0084143 A1 * 7/2002 Roy ..... E06C 7/44 182/204
2003/0057022 A1 * 3/2003 Leng ..... E06C 1/393 182/165
2004/0000449 A1 * 1/2004 Meeker ..... E06C 1/387 182/106
2005/0186023 A1 * 8/2005 Lee ..... F16B 7/105 403/109.3
2006/0102425 A1 * 5/2006 Moldthan ..... E06C 1/387 182/129
2007/0284192 A1 * 12/2007 Meyers ..... A47C 12/00 182/129
2008/0142301 A1 * 6/2008 Meyers ..... E06C 1/387 182/180.1
2010/0170750 A1 * 7/2010 Leng ..... E06C 1/393 182/219
2011/0024234 A1 * 2/2011 Lin ..... E06C 1/387 182/161
2011/0209946 A1 * 9/2011 Leng ..... A47C 12/00 182/129
2011/0284325 A1 * 11/2011 Chung ..... B62B 1/12 182/129
2014/0190769 A1 * 7/2014 Parker ..... E06C 1/383 182/159
2015/0068842 A1 * 3/2015 Moss ..... E06C 1/32 182/200
2017/0058930 A1 * 3/2017 Liu ..... F16B 7/105
2017/0067291 A1 * 3/2017 Leng ..... E06C 7/082

* cited by examiner

FOLDING LADDER WITH ARMREST

TECHNICAL FIELD

The present invention relates to a folding ladder with an armrest.

BACKGROUND OF THE INVENTION

Ladders are used to help people to fetch things in high position. Ladders comprise straight ladders, unilateral herringbone ladders, bilateral herringbone ladders and other different structure. Therein, as the herringbone ladder can be unfolded to stand stably on the ground when needed and be folded for storage when unneeded, this kind of ladder is the prior choice of the consumer with its convenient usage. However, existing herringbone ladder still has problem that when a person climbs to the top portion of the ladder, his hands have no place to hold, if there is no other fixing thing to hold around the ladder, the person standing on the top portion of the ladder feels unstable, he is easy to fall down, security risk exists.

SUMMARY OF THE INVENTION

The present invention is provided with a folding ladder with an armrest, which overcomes the disadvantages of the existing known technology. The technical proposal of the present invention is that:

A folding ladder with an armrest, comprising two front legs, two rear legs, two shaft sleeves and at least a footboard, two shaft sleeves are respectively sleeved on the top portion of the two front legs, the top portion of the two rear legs are respectively rotatably pivoted to the two shaft sleeves, the front leg and the rear leg form a foldable herringbone structure through the shaft sleeve, the front portion of one side of the footboard is pivoted to the front leg; wherein further comprising an armrest, the armrest comprises two movable bars and a link bar, two movable bars are respectively connected to the two front legs in stretchable way, the link bar is connected between the two movable bars; the shaft sleeve is disposed with an adjustable switch to control the movable bar to stretch out and draw back, the adjustable switch comprises a handle, a position pin disposed at one end of the handle and an elastic element disposed at the other end of the handle, the central portion of the handle is rotatably pivoted to the shaft sleeve, the front leg is disposed with a through hole corresponding to the position pin, the movable bar is disposed with a plurality of position holes corresponding to the position pin along the length direction; in normal state, the elastic element applies an elastic force on the handle to make the position pin inserted in the position hole through the through hole, the position pin draws out of the position hole by overcoming the elastic force and pressing down the handle to stretch the movable bar out or draw the movable bar back.

Compared to the existing known technology, the technical proposal of the present invention has advantages as follows:

The top portion of the ladder is disposed with an armrest, making it with armrest function. When the user climbs to the higher position, two hands can hold the armrest to provide balance, making the ladder with use security. The armrest is movably connected to the front leg, the movable bar is stretchable with respect to the front leg, the height of the armrest can be fast adjusted according to the height of the user, the present invention has strong function and is suitable to different persons with different height.

BRIEF DESCRIPTION OF THE DRAWINGS

The present invention will be further described in accordance with the drawings and the embodiments.

DETAILED DESCRIPTION OF THE EMBODIMENTS

Figure 1:
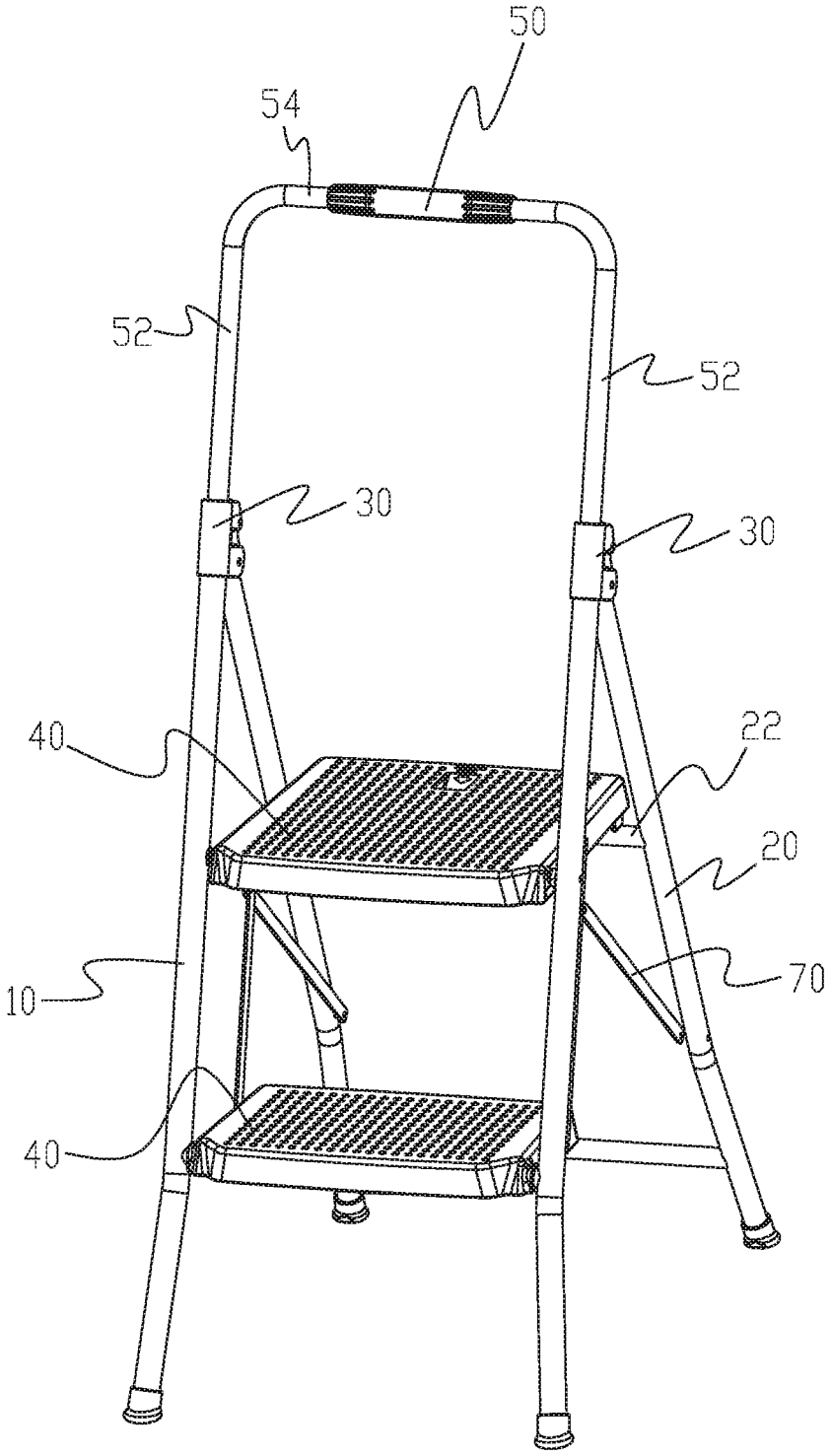
FIG. 1 illustrates a schematic diagram of a folding ladder with an armrest of the present invention.
Figure 2:
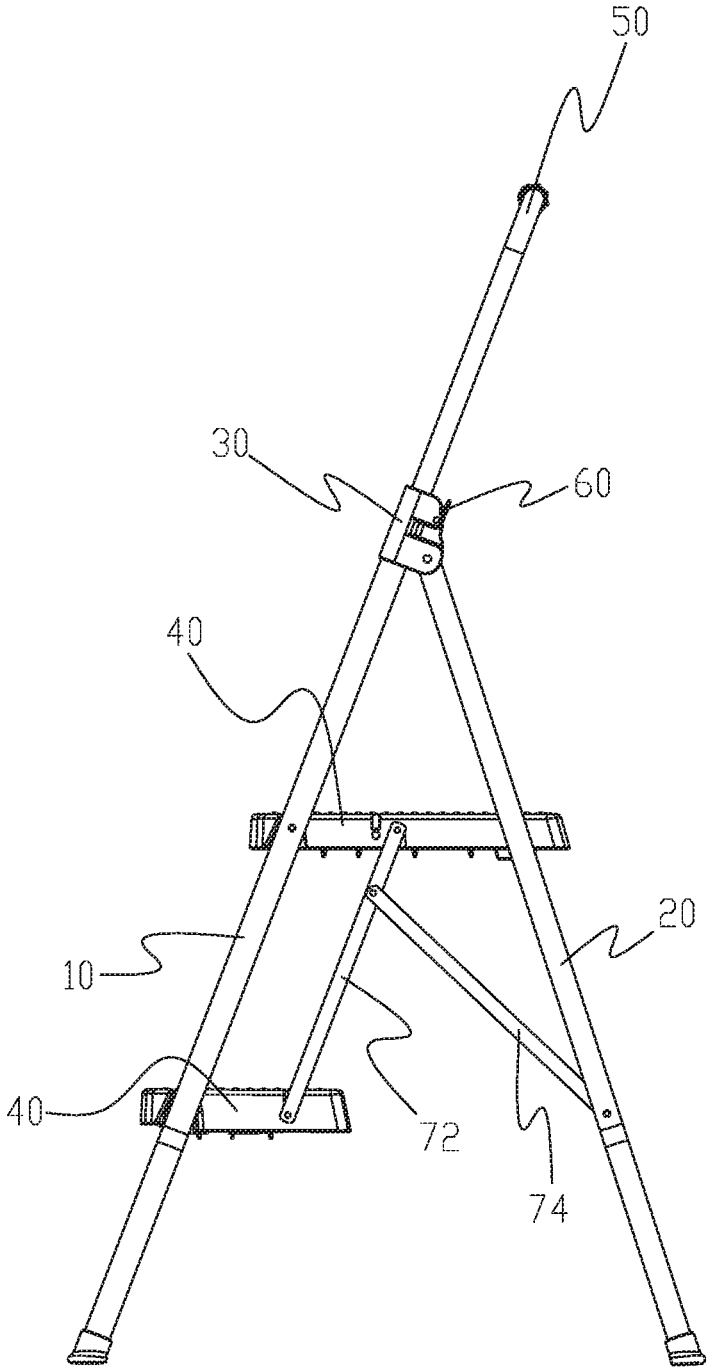
FIG. 2 illustrates a side diagram of the folding ladder with an armrest of FIG. 1.
Figure 3:
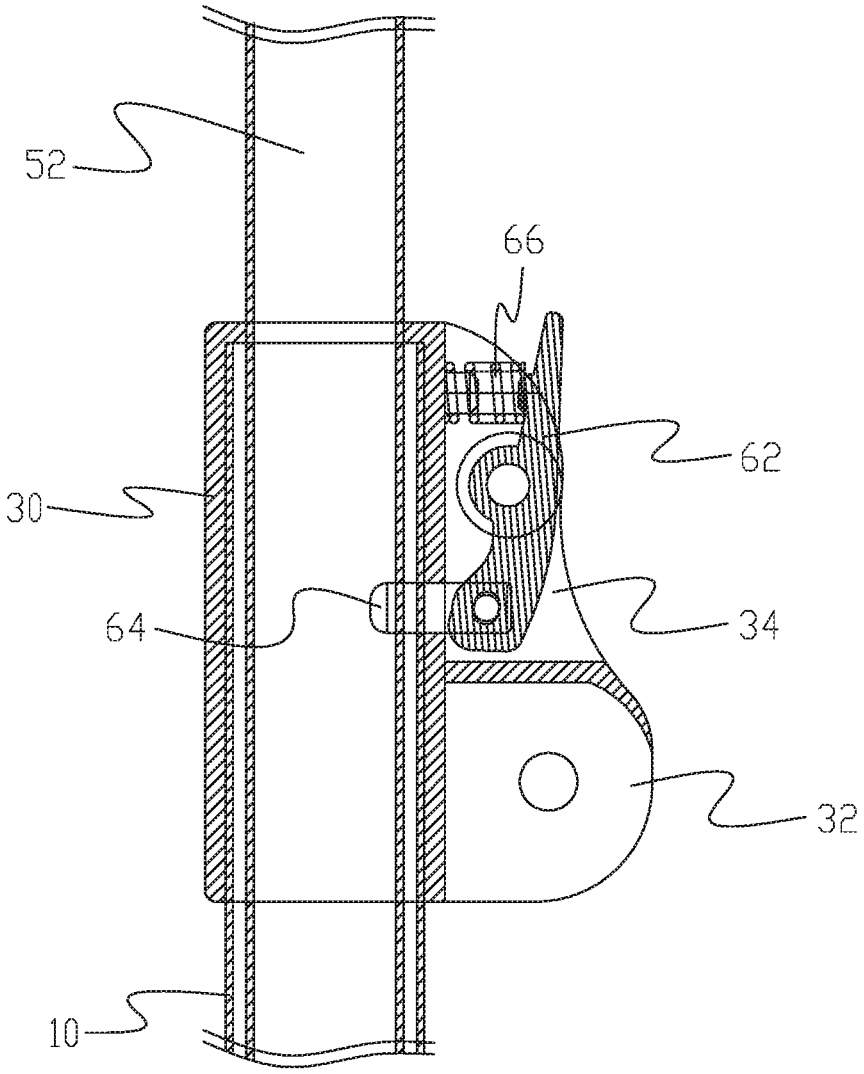
FIG. 3 illustrates a sectional diagram of the shaft sleeve portion of the folding ladder of FIG. 1.

Please referring to FIGS. 1-3, A folding ladder with an armrest comprises two front legs 10, two rear legs 20, two shaft sleeves 30 and at least a footboard 40, two shaft sleeves 30 are respectively sleeved on the top portion of the two front legs 10, the top portion of the two rear legs 20 are respectively rotatably pivoted to the two shaft sleeves 30, the front leg 10 and the rear leg 20 form a foldable herringbone structure through the shaft sleeve 30, the front portion of one side of the footboard 40 is pivoted to the front leg 10. The folding ladder with an armrest further comprises an armrest 50, the armrest comprises two movable bars 52 and a link bar 54, two movable bars 52 are respectively connected to the two front legs 10 in stretchable way, the link bar 54 is connected between the two movable bars 52; the shaft sleeve 30 is disposed with an adjustable switch 60 to control the movable bar 52 to stretch out and draw back, the adjustable switch 60 comprises a handle 62, a position pin 64 disposed at one end of the handle 62 and an elastic element 66 disposed at the other end of the handle 62, the central portion of the handle 62 is rotatably pivoted to the shaft sleeve 30; the front leg 10 is disposed with a through hole corresponding to the position pin, the movable bar 52 is disposed with a plurality of position holes corresponding to the position pin along the length direction; in normal state, the elastic element 66 applies an elastic force on the handle 62 to make the position pin 64 inserted in the position hole through the through hole, making the movable bar 52 and the front leg fixed. The position pin 64 draws out of the position hole by overcoming the elastic force and pressing down the handle 62 to stretch the movable bar 52 out or draw the movable bar 52 back, the movable 52 is then axially stretching out and the strengching length is adjustable.

The armrest 50 is U shaped with an integral structure, H shape is available, or assemble structure is available as well.

The front leg 10 is a hollow tube, the movable bar 52 is inserted in the front leg 10. The rear side of the shaft sleeve 30 is disposed with a pair of fixing pieces 32, the top portion of the rear leg 20 is disposed between the two fixing pieces 32 and is pivoted to the fixing pieces 32. The rear side of the shaft sleeve 30 is disposed with a pair of pivoting pieces 34, the handle 62 is disposed between the two pivoting pieces 34 and is pivoted to the pivoting pieces 34. The pivoting pieces 34 are disposed above the fixing pieces 32.

Preferred, this embodiment compriss two footboards 40 disposed with space upper and lower, a connecting bar 22 is disposed with the two rear legs 20, the connecting bar 22 supports the rear side of the bottom portion of the upper step 40 when the ladder is unfolded; it further comprises two symmetrical connecting mechanisms 70, the connecting mechanisms 70 are used to support the rear portion of the lower footboard 40. The connecting mechanism 70 comprises a pull bar 72 and a swing bar 74, two ends of the pull bar 72 are respectively rotatably pivoted to the rear portion of one side of the lower footboard 40 and the central portion of one side of the upper footboard 40, two ends of the swing bar 74 are respectively rotatably pivoted to the middle-upper portion of the pull bar 72 and the lower portion of the rear leg 20. In fact, the connecting mechanism 70 is the foldable herringbone structure. In addition, the connecting mechanism 70 can be a cross bar disposed between the two rear legs, the cross bar supports the rear portion of the lower footboard 40 when the ladder is unfolded.

Figure 4:
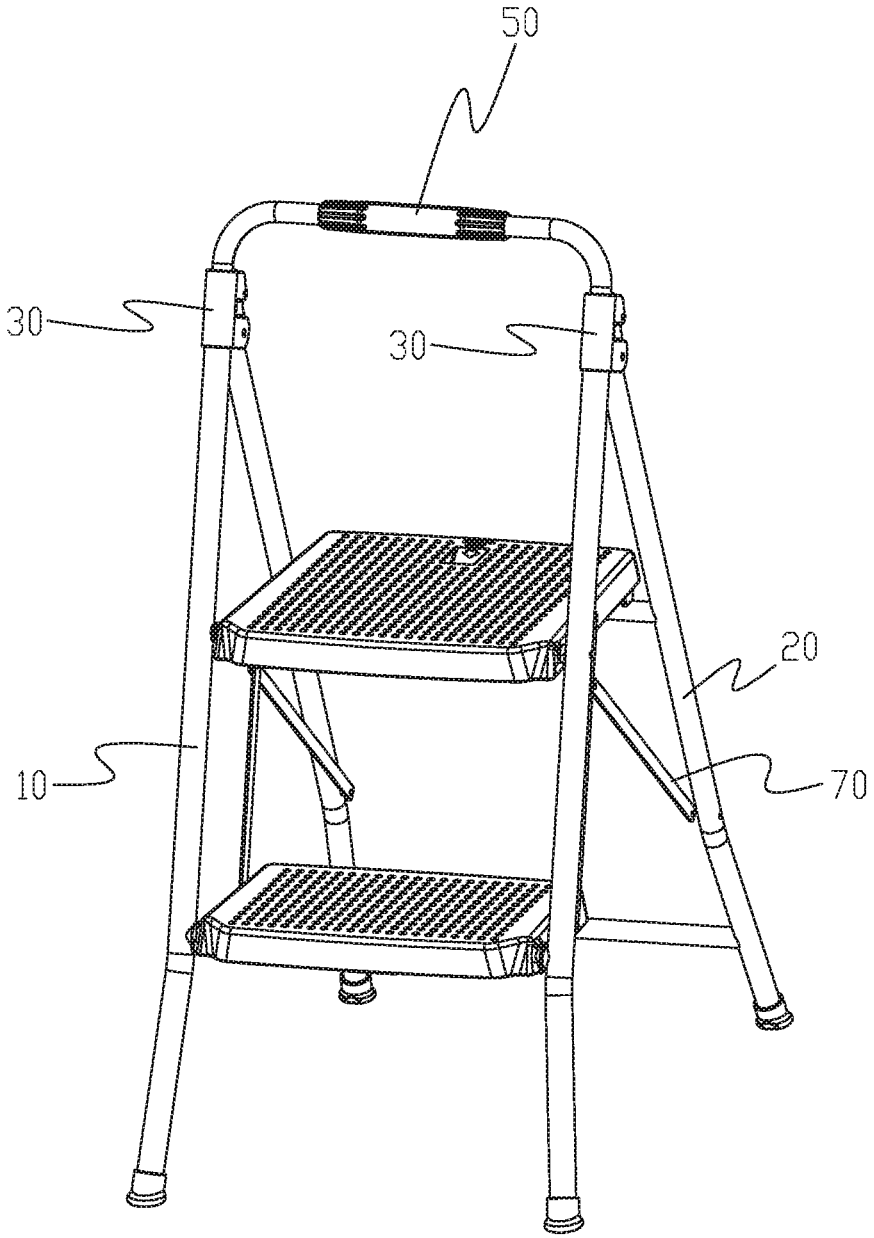
FIG. 4 illustrates a schematic diagram of the folding ladder of FIG. 1 with the armrest is dropped down.

Referring to FIG. 4, the movable bar 52 can stretch out and draw back by pressing the handle 62 down, the height of the armrest 50 is thus adjustable.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A folding ladder with an armrest, comprising:

two front legs, two rear legs, two shaft sleeves, at least one footboard, and the armrest, wherein:

each of the two shaft sleeves is disposed on a top portion of a corresponding one of the two front legs, a top portion of each of the two rear legs is rotatably connected to a corresponding one of the two shaft sleeves, each of the two rear legs and the corresponding one of the two front legs form a foldable structure through the corresponding one of the two shaft sleeves, a front portion of each of two sides of the at least one footboard is rotatably connected to the corresponding one of the two front legs, the armrest comprises two movable bars and a link bar, each of the two movable bars is connected to the corresponding one of the two front legs to define an extendable structure, the link bar is connected between the two movable bars, each of the two shaft sleeves comprises an adjustable switch to control at least a portion of a corresponding one of the two movable bars to extend out of the corresponding one of the two front legs and to draw back into the corresponding one of the two front legs, the adjustable switch comprises a handle, a position pin is disposed at a first end of the handle and an elastic element is disposed at a second end of the handle, a central portion of the handle is rotatably connected to the corresponding one of the two shaft sleeves, each of the two movable bars defines a plurality of position holes, each of the two front legs defines a first through hole, each of the two shaft sleeves defines a second through hole, the position pin is sized to be received within the second through hole, the first through hole, and the plurality of position holes of the corresponding one of the two movable bars, a rear side of each of the two shaft sleeves comprises a pair of fixing pieces, the top portion of a corresponding one of the two rear legs is disposed between the pair of fixing pieces and is rotatably connected to the pair of fixing pieces, the rear side of each of the two shaft sleeves comprises a pair of pivoting pieces, the handle is disposed between the pair of pivoting pieces and is rotatably connected to the pair of pivoting pieces, the pair of pivoting pieces are directly attached above the pair of fixing pieces, when holding each of the two movable bars into the corresponding one of the two front legs, the elastic element applies an elastic force on the handle to cause the position pin to be disposed in one of the plurality of position holes through the corresponding one of the first through holes and the corresponding one of the second through holes, and when extending each of the two movable bars out of the corresponding one of the two front legs or drawing each of the two movable bars back into the corresponding one of the two front legs, the position pin is configured to be drawn out of the one of the plurality of position holes by pressing down the handle and overcoming the elastic force.

2. The folding ladder with the armrest according to claim 1, wherein:

each of the two front legs is a hollow tube, and each of the two movable bars is inserted into a corresponding one of the two front legs.

3. The folding ladder with the armrest according to claim 1, wherein the pair of pivoting pieces is disposed above the pair of fixing pieces.

4. The folding ladder with the armrest according to claim 1, wherein:

the at least one footboard comprises an upper footboard and a lower footboard, a connecting bar is disposed between the two rear legs, the connecting bar is configured to support a rear side of a bottom portion of the upper footboard when the folding ladder is unfolded, the folding ladder further comprises two symmetrical connecting mechanisms, each of the two symmetrical connecting mechanisms comprises a pull bar and a swing bar, two ends of the pull bar are respectively rotatably connected to a rear portion of a corresponding side of the lower footboard and a central portion of a corresponding side of the upper footboard, and two ends of the swing bar are respectively rotatably connected to a middle-upper portion of the pull bar and a lower portion of the corresponding one of the two rear legs.

5. The folding ladder with the armrest according to claim 1, wherein the armrest is U shaped.

6. The folding ladder with the armrest according to claim 1, wherein the handle tapers in an upward direction away from the first end of the handle and is inclined in a direction away from a longest axis of a corresponding one of the two movable bars.

7. The folding ladder with the armrest according to claim 1, wherein each of the two shaft sleeves contact a top surface of the corresponding one of the two front legs.

8. The folding ladder with the armrest according to claim 7, wherein each of the two shaft sleeves contact a side surface of the corresponding one of the two movable bars.

9. The folding ladder with the armrest according to claim 1, wherein the elastic element contacts a sidewall of the corresponding one of the two shaft sleeves.

* * * * *